US005181003A

United States Patent [19]

Yamashita

[11] Patent Number: 5,181,003

[45] Date of Patent: Jan. 19, 1993

[54] ELECTROMAGNETIC SOLENOID VALVE

[75] Inventor: Shigeo Yamashita, Hyogo, Japan

[73] Assignee: Mitsubishi Denki K.K., Tokyo, Japan

[21] Appl. No.: 696,816

[22] Filed: May 7, 1991

[30] Foreign Application Priority Data

May 11, 1990 [JP] Japan ..... 2-49306[U]

[51] Int. Cl.[5] ..... H01F 5/00

[52] U.S. Cl. ..... 335/282; 335/255; 335/257; 335/277; 336/192

[58] Field of Search ..... 335/255, 257, 277, 282; 336/192, 198, 196, 197

[56] References Cited

U.S. PATENT DOCUMENTS

| | | | |
|---|---|---|---|
| 2,449,438 | 9/1948 | Wisegarver | 336/192 |
| 4,228,415 | 10/1980 | Schantz | 335/255 |
| 4,660,012 | 4/1987 | Bonniau et al. | 335/234 |
| 4,728,916 | 3/1988 | Frontecchio et al. | 335/255 |

*Primary Examiner*—Gerald P. Tolin
*Assistant Examiner*—Ramon Barrera
*Attorney, Agent, or Firm*—Sughrue Mion Zinn Macpeak & Seas

[57] ABSTRACT

An electromagnetic solenoid valve in which a projecting portion disposed on a coil bobbin is abutted against and engaged with a plate so that rotation of the coil bobbin is stopped. As a result of this simple construction, shortcircuiting between the terminal of the coil and the plate can be prevented.

3 Claims, 2 Drawing Sheets

ELECTROMAGNETIC SOLENOID VALVE

BACKGROUND OF THE INVENTION

The invention relates to a structure of an electromagnetic solenoid valve used to introduce air into a negatively pressurizing path of, e.g., an actuator of an electrically driven suction pump.

FIG. 3 is a plan view showing a structure of an exemplary conventional electromagnetic solenoid valve of this type; and FIG. 4 is a front sectional view showing the electromagnetic solenoid valve shown in FIG. 3.

In FIGS. 3 and 4, a coil assembly 1 is made up of a coil bobbin 1*a*, a coil 1*b* wound on the coil bobbin 1*a*, a terminal outlet 1*c* of the coil 1*b* and a terminal 1*d*. Reference numeral 2 designates a core inserted into the coil bobbin 1*a*; 3, a plunger vertically reciprocating within the coil bobbin 1*a* while confronting the core 2; 4, 5, plates serving as magnetic flux paths; and 6, a spring for biasing the plunger.

The operation of the above conventional electromagnetic solenoid valve will now be described. Upon application of a line voltage to the terminal 1*d*, the coil 1*b* wound around the coil bobbin 1*a* is energized and generates a magnetic field, thereby exciting the plunger 3. The excited plunger 3 is attracted to the core 2 while resisting the biasing force of the spring 6.

Upon interruption of the application of the line voltage to the terminal 1*d*, the plunger 3 is returned to its original position by the biasing force of the spring 6.

In the conventional electromagnetic solenoid valve thus constructed, the coil assembly 1 and the plate 4 are fixed only by an adhesive or the like as shown in FIG. 3, but are not provided with a rotation stopper. Thus, should the adhesive fixation between the coil assembly 1 and the plate 4 be destroyed during the operation of the electromagnetic solenoid valve, the electromagnetic solenoid valve including the coil assembly 1 which would be free to rotate, may shortcircuit between the terminal 1*d* of the coil assembly 1 and the plate 4, thereby preventing current across the coil 1*b* of the coil assembly 1, flow and potentially making the plunger 3 inoperative.

The present invention has been made in view of the problems mentioned above. Accordingly, an objective of the invention is to provide an electromagnetic solenoid valve constructed such that a terminal of coil and a plate serving as a magnetic path will not be shortcircuited.

SUMMARY OF THE INVENTION

To achieve the above objective, the present invention is applied to an electromagnetic solenoid valve in which a projecting portion disposed on a coil bobbin is abutted against and engaged with a plate so that the coil bobbin will not rotate.

As a result of the construction of the present invention featuring the rotation stopper, shortcircuiting between the terminal of the coil and the plate can be prevented.

DETAILED DESCRIPTION OF THE PREFERRED EMBODIMENTS

Figure 1:
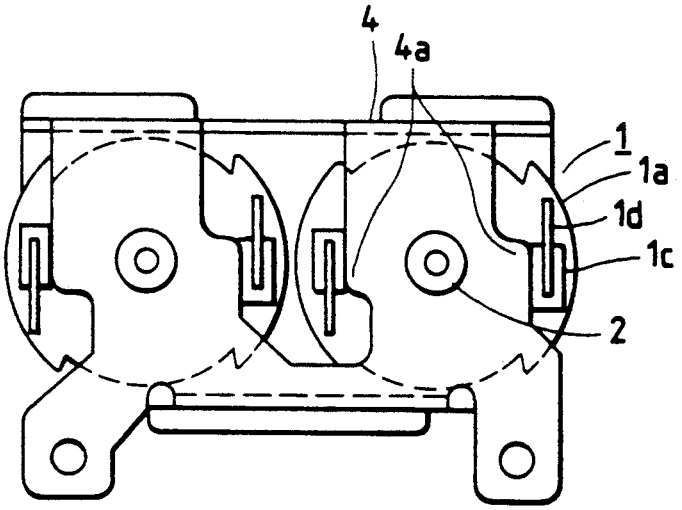
FIG. 1 is a plan view of one embodiment of the present invention showing a coil assembly and a plate of an electromagnetic solenoid valve; which is an embodiment of the invention.

FIG. 1 is a plan view showing a coil assembly and a plate of an electromagnetic solenoid valve, and is one embodiment of the present invention.

Figure 3:
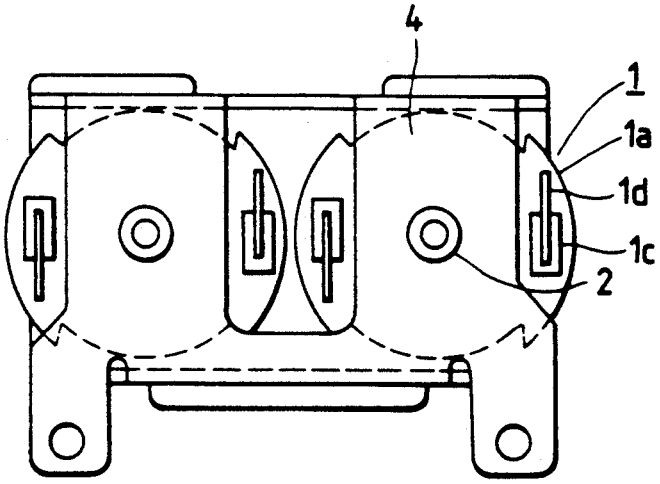
FIG. 3 PRIOR ART
FIG. 3 is a plan view showing a conventional electromagnetic solenoid valve.
Figure 4:
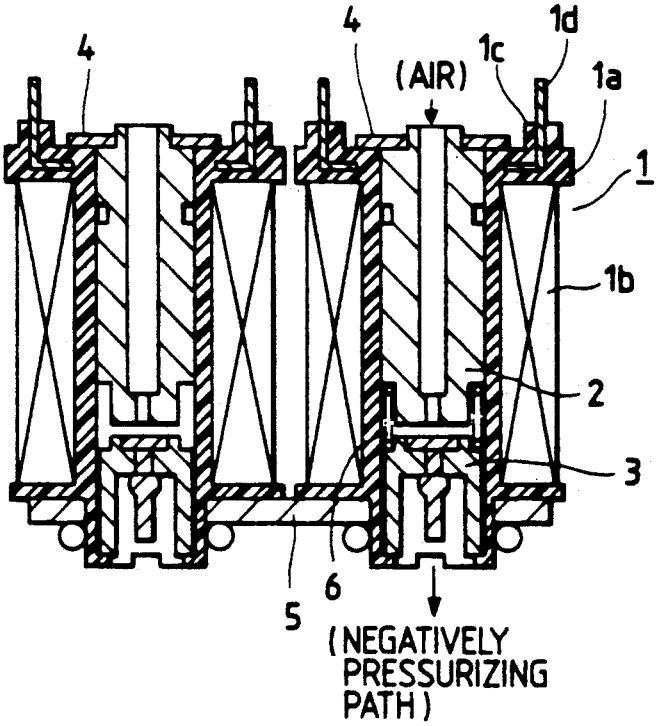
FIG. 4 PRIOR ART
FIG. 4 is a front sectional view of the electromagnetic solenoid valve shown in FIG. 3.

In FIG. 1, a rotation stopper portion 4*a* is disposed on a plate 4 so as to be abutted against and engaged with an outlet 1*c* of a coil assembly 1. Other aspects of the construction are the same as in the conventional valve shown in FIGS. 3 and 4, and the descriptions thereof will therefore be omitted. According to the embodiment shown in FIG. 1, the rotation stopper portion 4*a* is arranged so as to be abutted against and engaged with the outlet 1*c* of the coil assembly 1. This keeps the coil assembly 1 from rotating during the operation of the electromagnetic solenoid valve, thereby eliminating the risk of shortcircuiting between the terminal 1*d* of the coil assembly 1 and the plate 4.

Figure 2:
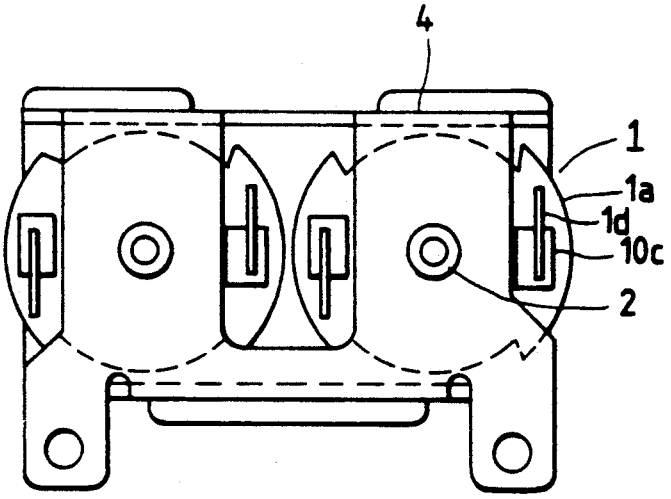
FIG. 2 is a plan view of another embodiment of the present invention showing a coil assembly and a plate of an electromagnetic solenoid valve.

FIG. 2 is a plan view showing a coil assembly and a plate of an electromagnetic solenoid valve, and is another embodiment of the invention.

In FIG. 2, an terminal outlet 10*c*, which is formed to be so wide as to be engaged with the plate 4, is abutted against the plate 4, thereby preventing the rotation of the coil assembly 1.

In addition to the above embodiments, the same advantage may be obtained by specially arranging a projecting portion so that the projecting portion is abutted against and engaged with the plate 4 to stop the rotation of the coil assembly 1. Further, the projecting portion of the coil assembly (e.g., the terminal outlet) may be adhesively fixed to the plate 4.

As a result of this simple construction, rotation of the coil bobbin is prevented and, therefore, the shortcircuiting between the coil terminal and the plate is also prevented, thus providing an electromagnetic solenoid valve with excellent performance characteristics.

What is claimed is:

1. An electromagnetic solenoid valve, comprising:
   - a coil bobbin;
   - a coil being wound around said coil bobbin;
   - a core being inserted into said coil bobbin;
   - a plunger which confronts said core and reciprocates within said coil bobbin;
   - a terminal for supplying a current to said coil, said terminal being fixedly attached to one end of said coil bobbin; and
   - a polygonal plate disposed at said one end of said coil bobbin, for forming a magnetic path;
   - wherein said coil bobbin is provided with a rectangular projecting portion, one side of which abuts against and is engaged with a linear edge of said polygonal plate to thereby prevent rotation of said coil bobbin and to prevent shortcircuiting between said terminal and said plate, and projecting portion comprising a terminal outlet provided for said terminal.

2. The valve as claimed in claim 1, wherein said plate is provided with a rotation stopper portion against which said projecting portion of said coil bobbin is abutted.

3. The valve as claimed in claim 1, wherein said projecting portion is adhesively fixed to said plate.

* * * * *